US005597315A

United States Patent [19]

Taguchi

[11] Patent Number: 5,597,315

[45] Date of Patent: Jan. 28, 1997

[54] CONNECTOR WITH ENGAGING LEVER

[75] Inventor: Naoto Taguchi, Haibara-gun, Japan

[73] Assignee: Yazaki Corporation, Tokyo, Japan

[21] Appl. No.: 376,966

[22] Filed: Jan. 23, 1995

[30] Foreign Application Priority Data

Jan. 26, 1994 [JP] Japan ..... 6-006817

[51] Int. Cl.[6] ..... H01R 13/62

[52] U.S. Cl. ..... 439/157; 439/159

[58] Field of Search ..... 439/152–160, 439/372

[56] References Cited

U.S. PATENT DOCUMENTS 5,252,084 10/1993 Wakata ..... 439/157
5,417,513 5/1995 Hayashi ..... 439/160

FOREIGN PATENT DOCUMENTS 58-178289 11/1983 Japan .
5-34676 5/1993 Japan .
5-48246 6/1993 Japan .

*Primary Examiner*—David L. Pirlot
*Assistant Examiner*—Brian J. Biggi
*Attorney, Agent, or Firm*—Armstrong, Westerman, Hattori, McLeland & Naughton

[57] ABSTRACT

A pair of connectors with an engaging lever comprising: a first housing having an engaging lever pivotally attached thereto; a second housing which is coupled and uncoupled to the first housing by being engaged by with the engaging lever; wherein the engaging lever is composed of an operative piece and an actuating handle which are separately formed, connecting portions being provided on each of the operative piece and the actuating handle for connecting with each other, and the connecting portions being connected to form the combined engaging lever. Engaging levers having the same operative piece in structure or size and having a modified actuating handle only in length can be applied to various connector housings differing in lateral width.

6 Claims, 4 Drawing Sheets

CONNECTOR WITH ENGAGING LEVER

BACKGROUND OF THE INVENTION (1) Field of the Invention

This invention relates to a pair of improved connectors engaging with each other and having an engaging lever by which the pair of connectors can be coupled and uncoupled.

(2) Prior Art

In reference to connectors with engaging levers, for example, a pair of conventional connectors L with an engaging lever as embodied in Japanese Utility Model Preliminary Publication No. 58-178289 is disclosed in FIG. 8.

The pair of connectors L with an engaging lever is composed of a female connector housing a and a male connector housing b, and, to the female connector housing a, a lever c is pivotally attached. On both side walls of the male connector housing b, projections d are formed, and, on both side walls of the female connector housing a, guiding channels al for the projections are formed.

The projections d on the male housing b are inserted into cam grooves e formed on operative portions cl of the engaging lever c. By pivoting an actuating handle c2 of the lever c, the male connector housing b is pulled into and engaged with the female connector housing a or is pushed and separated from the female connector housing a.

In such an engaging lever c of the pair of connectors L, an operative piece cl and an actuating handle c2 are typically integrally formed by molding synthetic resin materials.

Therefore, when a width of the connector housings is made larger or smaller to increase or decrease a number of terminals in the connectors, as a new engaging lever c with a corresponding longer or shorter actuating handle c2 is integrally formed in every case, a new forming die is required and it creates a need to increase a number of parts prepared for forming various levers in length and results in a large amount of production costs. Thus, the pair of conventional connectors L with an engaging lever has such a drawback.

SUMMARY OF THE INVENTION

The present invention has been accomplished to overcome the above-mentioned drawback and its object is to provide a pair of connectors with an engaging lever, which appropriately copes with the connector housings in various widths by changing only a part of composing members.

To achieve the object, a pair of connectors with an engaging lever, according to this invention, comprises:

- a first housing having an engaging lever pivotally attached thereto;
- a second housing which is coupled and uncoupled to said first housing by being actuated by said engaging lever;
- wherein said engaging lever is composed of an operative piece and an actuating handle which are separately formed, connecting portions being provided on both of said operative piece and said actuating handle for connecting with each other, and said connecting portions being connected to form said combined engaging lever.

Further, said connecting portions on both of said operative piece and said actuating handle are preferably formed as locking hooks for engaging with each other.

In the pair of connectors with an engaging lever according to this invention, as the engaging lever for making the pair of connector housings coupled and uncoupled is composed of operative pieces and an actuating handle which are each separately formed, a longer actuating handle can be connected to the operative pieces for connector housings of larger lateral width, and a shorter actuating handle can be connected to the operative pieces for connector housings of smaller lateral width. Thus, the engaging lever can cope with various connectors differing in width. For example, in connector housings differing only in lateral width and receiving the same kind of terminals, the same operative pieces in structure/size are utilized and only lengths of the actuating handle are modified to be able to form engaging levers applied to housings differing in lateral width.

While, alternatively, to some kinds of connector housings engaging levers having modified operative pieces and having the same actuating handles may be applied.

When each of the connecting portions of the respective operative pieces and the actuating handle are formed as locking hooks, the operative pieces and the actuating handle can be fully locked by only depressing each of the connecting portions to each other. As the locking function is firm and cannot come off easily, engaging levers may be readily formed by a very simple process.

DETAILED DESCRIPTION OF PREFERRED EMBODIMENT

Figure 1:
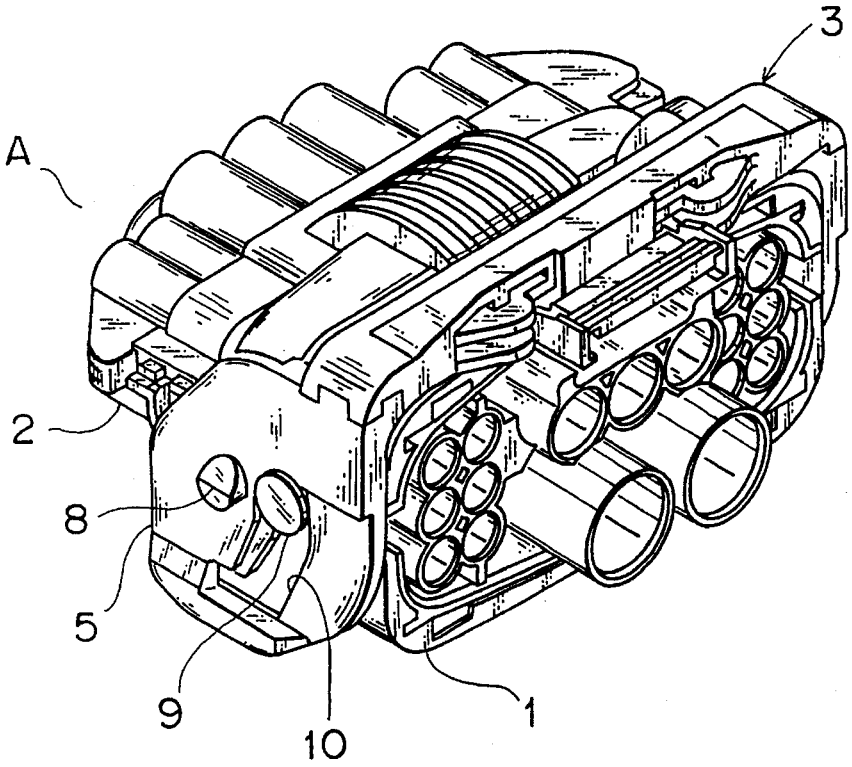
FIG. 1 is a perspective view of one embodiment of a pair of connectors with an engaging lever according to this invention.

FIG. 1 is a perspective view of one embodiment of a pair of connectors A with an engaging lever according to this invention. A pair of connectors A with an engaging lever comprises a first connector housing 1, a second connector housing 2, and an engaging lever 3. Each of the connector housings is coupled to each other and, in each of the first connector housing 1 and the second connector housing 2, plural pairs of terminals (not illustrated) are received to be mated so as to make electrical connections to each other.

Figure 2:
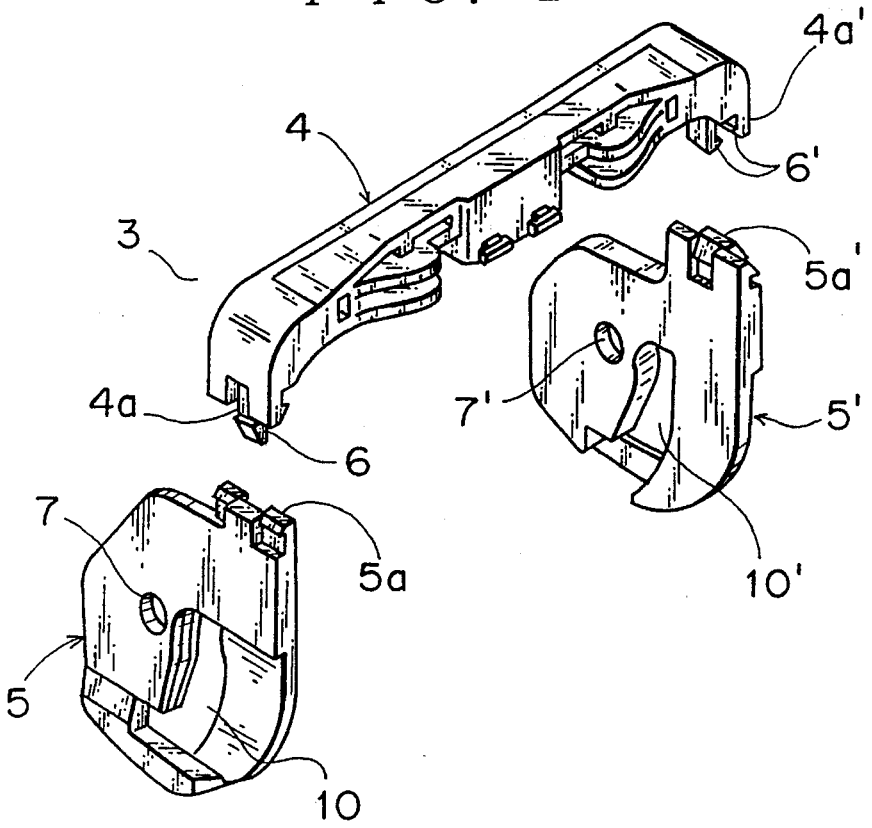
FIG. 2 is a perspective view of the engaging lever illustrated in FIG. 1 separated into its respective parts.

In FIG. 2, the engaging lever 3 is shown separated into its respective parts and is composed of a bridge-shaped actuating handle 4 and plate-shaped operative pieces 5 / 5' connected to the each end of the actuating handle 4.

Figure 3:
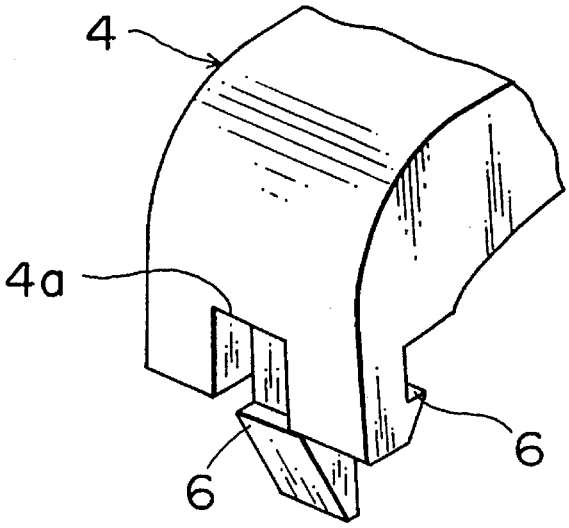
FIG. 3 is a perspective view of the connecting portion on one side of the actuating handle illustrated in FIG. 2.
Figure 4:
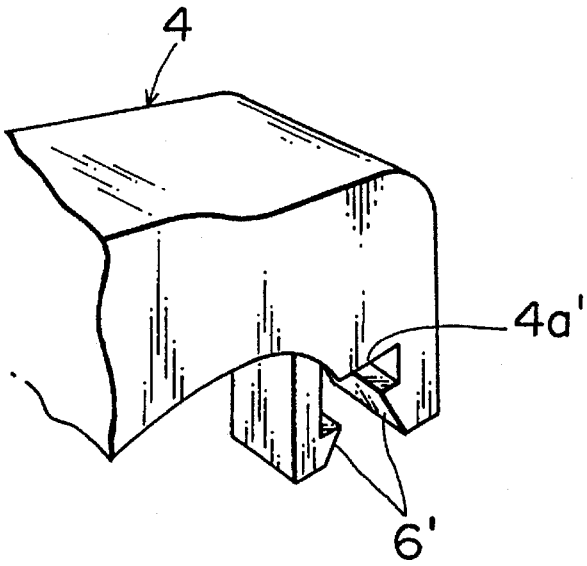
FIG. 4 is a perspective view of the connecting portion on the other side of the actuating handle illustrated in FIG. 2.

On the each end of the actuating handle 4, as shown in FIG. 3 and FIG. 4, connecting port ions **4*a*/4*a*' having each of locking hooks 6/6'** are formed.

On the operative pieces 5/5', axial openings 7/7' are formed at an approximately middle portions thereof. Each of the axial openings receives a supporting projection 8 formed on each end of the first connector housing 1 such that the operative pieces 5/5' can be pivotally supported by the first connector housing 1. Further, on the operative pieces 5/5', cam grooves 10/10' receiving pins 9 projected and formed on both ends of the second connector housing 2 are provided. When the pins 9 have been inserted into the cam grooves 10/10' and the operative pieces 5/5' are pivoted, as the pins are guided by the cam grooves 10/10', the second connector housing 2 can be pulled into and coupled to the first connector housing 1 or can be disengaged from the first connector housing 1 from be uncoupled to it.

Figure 5:
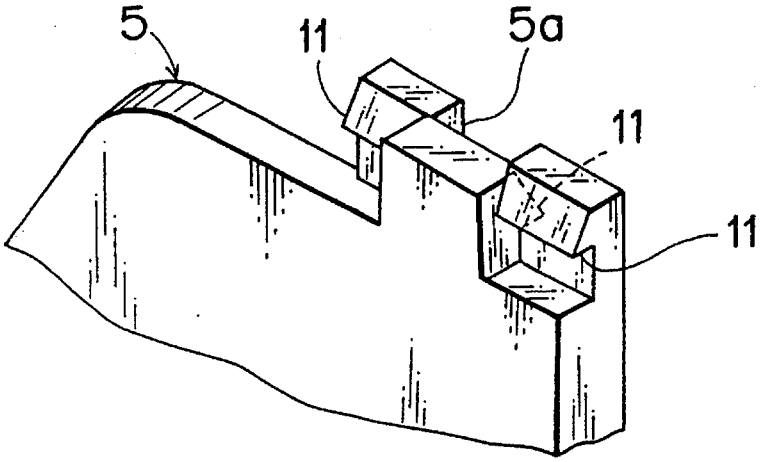
FIG. 5 is a perspective view of the connecting portion of one side of the operative piece illustrated in FIG. 2.
Figure 6:
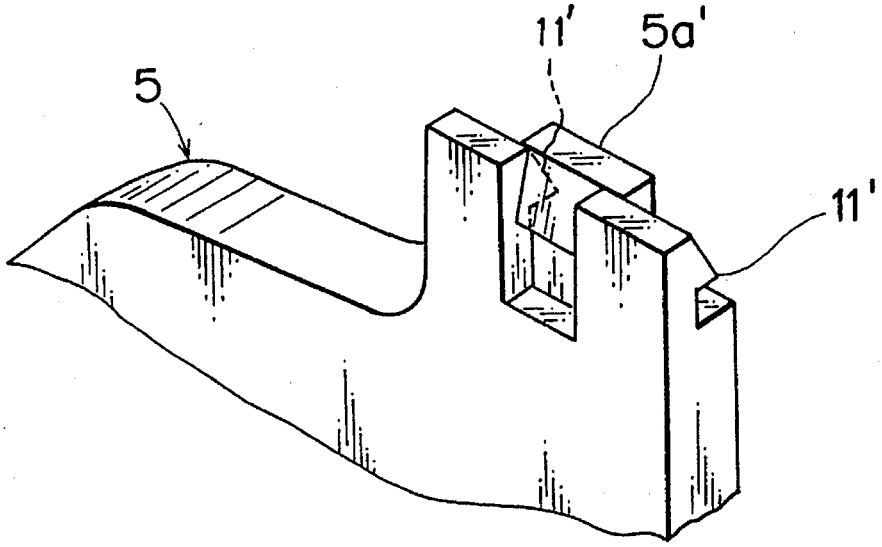
FIG. 6 is a perspective view of the connecting portion of the other side of the actuating handle illustrated in FIG. 2.

On an upper periphery of the operative pieces 5/5', as shown in FIGS. 5 and 6, each of connecting portions **5*a*/5*a*' having each of locking hooks 11/11'** is provided.

Figure 7:
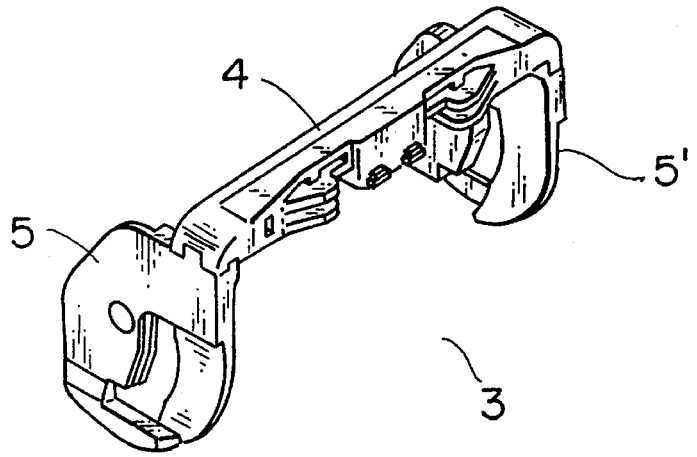
FIG. 7 is a perspective view of the engaging lever illustrated in FIG. 2, and the operative pieces and the actuating handle being fully locked.
Figure 8:
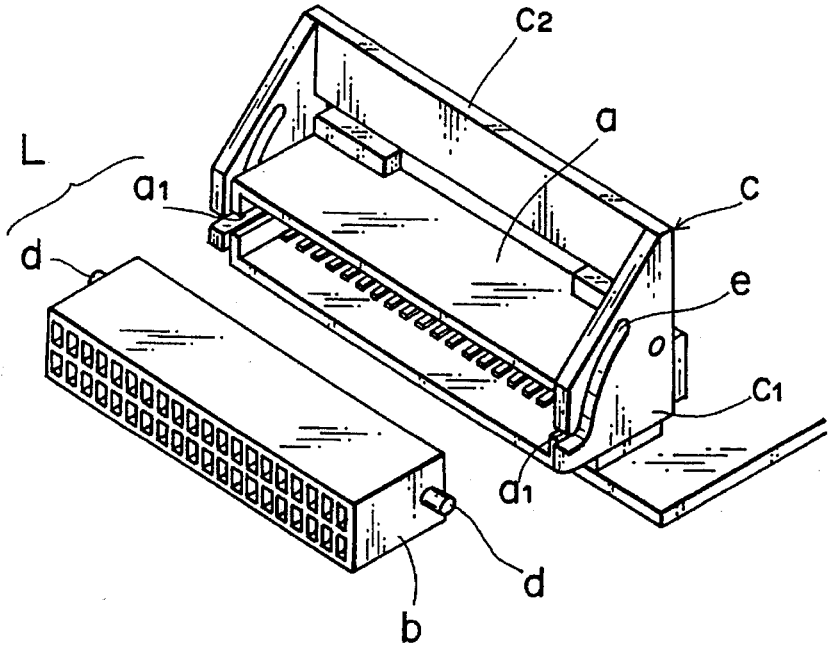
FIG. 8 PRIOR ART
FIG. 8 is a perspective view of a pair of conventional connectors with an engaging lever.

In order to form the engaging lever 3, the connecting portions **4*a*/4*a*' of the actuating handle 4 and the connecting portions 5*a*/5*a*' of the operative piece 5 are abutted and depressed into engagement with each other respectively. By the depressing, each of the locking hooks 6/6' is fully locked to each of the locking hooks 11/11', as shown in FIG. 7, so that the actuating handle 4 and the operative pieces 5/5' can be connected to form the combined engaging lever 3. In operation, the operative pieces 5/5' can be easily pivoted by moving the actuating handle 4 of the combined engaging lever 3**.

In regard to the actuating handle 4, various operating handles differing in length and shape and having the connecting portions **4*a*/4*a*' in the same structure and size are prepared, for each of plural pairs of connectors having the operative pieces 5/5'** in the same structure and size, an appropriate actuating handle can be selected and connected to the operative pieces to form the engaging lever.

It may be possible also that an engaging lever having modified operative pieces and having the same actuating handle can be applied to connector housings differing in structure.

In the pair of connectors with an engaging lever according to this invention, as the engaging lever making the pair of connector housings coupled or uncoupled is composed of the operative piece and the actuating handle, which are separately formed, engaging levers having the same operative pieces in structure or size and having a modified actuating handle only in length can be applied to various connector housings differing in lateral width. While, to different kinds of connector housings, engaging levers having modified operative pieces and having the same actuating handle also may be applied.

Therefore, for many kinds of connector housings, the disclosed invention can reduce the number of parts that must be prepared for forming the connector housings and reduces also the number of forming dies and their corresponding elements. Moreover, it is distinguished from conventional gate-shaped engaging levers which are integrally formed in structure, because it has no deformation in the forming process, which results advantageously to improve quality of final products.

What is claimed is:

1. A pair of connectors with an engaging lever comprising:

a first housing having an engaging lever pivotally attached thereto;

a second housing for coupling and uncoupling to said first housing by actuation by said engaging lever; and said engaging lever containing a pair of operative pieces and an interconnecting actuating handle which are each separately formed, cooperating connecting portions being provided on each of said operative pieces and said actuating handle for interconnecting each other, and said connecting portions, when interconnected, forming said combined engaging lever, wherein each connecting portion comprises locking hooks on said operative piece having a pair of mutually oppositely disposed hooking edges, and a cooperating end of said actuating handle containing a pair of mutually oppositely disposed hooking edges cooperable with, and disposed in opposition to, said hooking edges on said operative piece for latched connection therewith.

2. A pair of connectors with an engaging lever as claimed in claim 1, wherein, on a couple of said operative pieces, an axial opening is formed respectively at an approximately middle portion thereof, and each of supporting projections received into each of said axial openings is formed on each side end of said first connector housing.

3. A pair of connectors with an engaging lever as claimed in claim 2, wherein, on said operative pieces, cam grooves which receive pins projected and formed on both side ends of said second connector housing are provided.

4. A pair of connectors with an engaging lever as claimed in claim 1 in which cooperating locking hooks on said operative piece and said actuating handle in each connecting portion are resilient and define hooking edges on one member which cooperate with hooking edges on a cooperating member that, when latched, prevent relative vertical movement between the members.

5. A pair of connectors with an engaging lever as claimed in claim 4 including means forming a recessed slot adjacent a locking hook in each member for reception of a locking hook of the cooperating member.

6. A pair of connectors with an engaging lever as claimed in claim 5 wherein each member in each connecting portion comprises a pair of laterally spaced locking hooks having hooking edges disposed in one direction and the space between said locking hooks containing said recessed slot and having a hooking edge disposed in a direction opposite that of said pair of hooking edges.

* * * * *